US011848136B2

(12) United States Patent
Kim et al.

(10) Patent No.: US 11,848,136 B2
(45) Date of Patent: Dec. 19, 2023

(54) COIL COMPONENT

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 490 days.

(21) Appl. No.: 16/952,505

(22) Filed: Nov. 19, 2020

(65) Prior Publication Data

US 2022/0013271 A1 Jan. 13, 2022

(30) Foreign Application Priority Data

Jul. 8, 2020 (KR) ..... 10-2020-0083864

(51) Int. Cl.
*H01F 27/00* (2006.01)
*H01F 17/04* (2006.01)
*H01F 27/29* (2006.01)

(52) U.S. Cl.
CPC ..... *H01F 27/006* (2013.01); *H01F 17/04* (2013.01); *H01F 27/292* (2013.01); *H01F 2017/048* (2013.01)

(58) Field of Classification Search
CPC ..... H01F 27/006; H01F 17/04; H01F 27/292; H01F 2017/048
See application file for complete search history.

(56) References Cited

U.S. PATENT DOCUMENTS

2015/0102891 A1* 4/2015 Yoon ..... H01F 27/2804 336/200
2016/0078986 A1* 3/2016 Yoon ..... H01F 5/04 336/83

(Continued)

FOREIGN PATENT DOCUMENTS

CN 108172376 A * 6/2018 ..... H01F 10/00
KR 10-2015-0044372 A 4/2015

(Continued)

OTHER PUBLICATIONS

"Wurth, WE-MAPI, 2510 Wire-wound SMD Inductor with a Composite Iron Powder Core, 4.7 μH ±20% Moulded 940mA Idc, " (https://sg.rs-online.com/web/p/wire-wound-surface-mount-inductors/7922720/).

*Primary Examiner* — Bickey Dhakal
*Assistant Examiner* — Malcolm Barnes
(74) *Attorney, Agent, or Firm* — Morgan, Lewis & Bockius LLP

(57) ABSTRACT

A coil component includes a body having one end and the other end opposing each other, a support substrate disposed inside the body, a coil portion, disposed on at least one surface of the support substrate, in which an end portion of an outermost turn is disposed closer to the one surface of the body than to the other surface of the body, a lead-out portion connected to the outermost turn of the coil portion and exposed to the one surface of the body, and an anchor portion connected to the lead-out portions and including a via pad disposed between the lead-out portion and the coil portion inside the body.

20 Claims, 9 Drawing Sheets

(56) References Cited

U.S. PATENT DOCUMENTS

| | | | | |
|---|---|---|---|---|
| 2016/0189840 | A1* | 6/2016 | Ahn | H01F 17/04 29/602.1 |
| 2017/0018351 | A1* | 1/2017 | Yatabe | H01F 27/2804 |
| 2017/0098997 | A1* | 4/2017 | Hamada | G06F 1/3296 |
| 2018/0012700 | A1* | 1/2018 | Lee | H01F 17/0013 |
| 2018/0174727 | A1* | 6/2018 | Kim | H01F 17/0013 |
| 2018/0358171 | A1* | 12/2018 | Jung | H01F 17/0013 |
| 2019/0066905 | A1* | 2/2019 | Hong | H01F 41/043 |
| 2019/0074126 | A1* | 3/2019 | Kim | H01F 17/0013 |
| 2019/0096564 | A1* | 3/2019 | Park | H01F 27/292 |
| 2019/0122795 | A1* | 4/2019 | Lee | H01F 17/0013 |
| 2019/0156977 | A1* | 5/2019 | Jung | H01F 5/04 |
| 2019/0198223 | A1* | 6/2019 | Kim | H01F 17/04 |

FOREIGN PATENT DOCUMENTS

| | | | |
|---|---|---|---|
| KR | 10-1662209 | B1 | 10/2016 |
| KR | 10-1670184 | B1 | 10/2016 |
| KR | 10-2019-0062342 | A | 6/2019 |
| KR | 10-2191248 | B1 | 12/2020 |

* cited by examiner

COIL COMPONENT

CROSS-REFERENCE TO RELATED APPLICATION(S)

The present application claims the benefit of priority to Korean Patent Application No. 10-2020-0083864, filed on Jul. 8, 2020 in the Korean Intellectual Property Office, the entire disclosure of which is incorporated herein by reference.

TECHNICAL FIELD

The present disclosure relates to a coil component.

BACKGROUND

An inductor, a coil component, is a typical passive electronic component used in electronic devices, along with a resistor and a capacitor.

As electronic devices gradually gain higher performance and become smaller, the number of electronic components used in electronic devices is increased, while being miniaturized.

In the case of a thin-film type coil component, a body is formed on a substrate, on which a coil portion is formed, by laminating and curing a magnetic composite sheet in which magnetic metal powder particles are dispersed in an insulating resin, and an external electrode is formed on a surface of the body.

SUMMARY

An aspect of the present disclosure is to improve bonding strength between a body and a coil portion.

Another aspect of the present disclosure is to improve bonding strength between a body and a lead-out portion.

Another aspect of the present disclosure is to increase the number of turns of a coil portion.

According to an aspect of the present disclosure, a coil component includes a body having one end and the other end opposing each other, a support substrate disposed inside the body, a coil portion, disposed on at least one surface of the support substrate, in which an end portion of an outermost turn is disposed closer to the one surface of the body than to the other surface of the body, a lead-out portion connected to the outermost turn of the coil portion and exposed to the one surface of the body, and an anchor portion connected to the lead-out portions and including a via pad disposed between the lead-out portion and the coil portion inside the body.

According to an aspect of the present disclosure, a coil component includes a body having one surface and the other surface opposing each other, a support substrate disposed inside the body, a coil portion disposed on the support substrate, a lead-out portion connected to an outermost turn of the coil portion and exposed to the one surface of the body, and an anchor portion extending from the lead-out portion to a space between the coil portion, the lead-out portion, and a side surface of the body connecting the one surface and the other surface.

According to an aspect of the present disclosure, a coil component includes a body having one surface and the other surface opposing each other, a support substrate disposed inside the body, a coil portion disposed on the support substrate, a lead-out portion connected to an outermost turn of the coil portion and exposed to the one surface of the body, and a conductive pattern, including a same material as the lead-out portion, extending from the lead-out portion to a space between the coil portion, the lead-out portion, and a side surface of the body connecting the one surface and the other surface.

BRIEF DESCRIPTION OF DRAWINGS

The above and other aspects, features, and advantages of the present disclosure will be more clearly understood from the following detailed description, taken in conjunction with the accompanying drawings.

DETAILED DESCRIPTION

Figure 1:
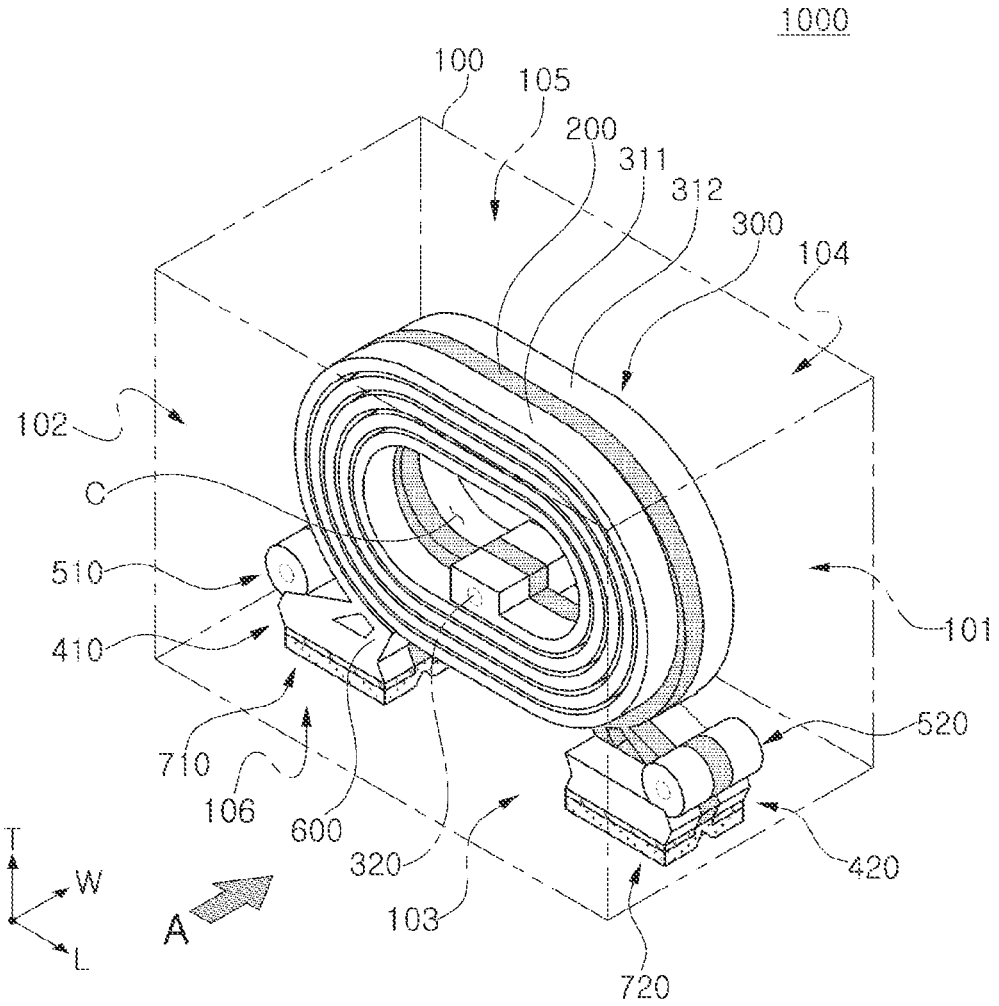
FIG. 1 is a schematic perspective view of a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
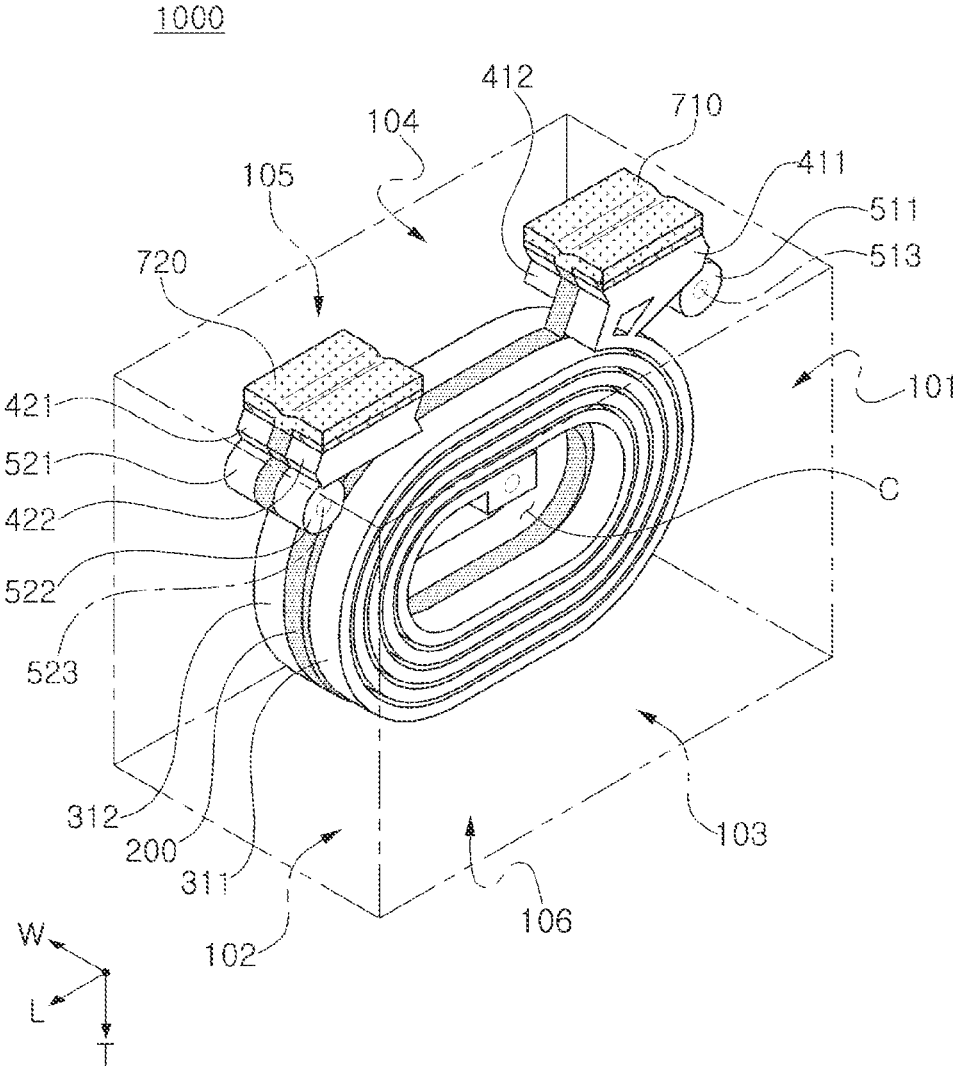
FIG. 2 is a schematic perspective view of the coil component according to the first embodiment of the present disclosure when viewed from below.
Figure 3:
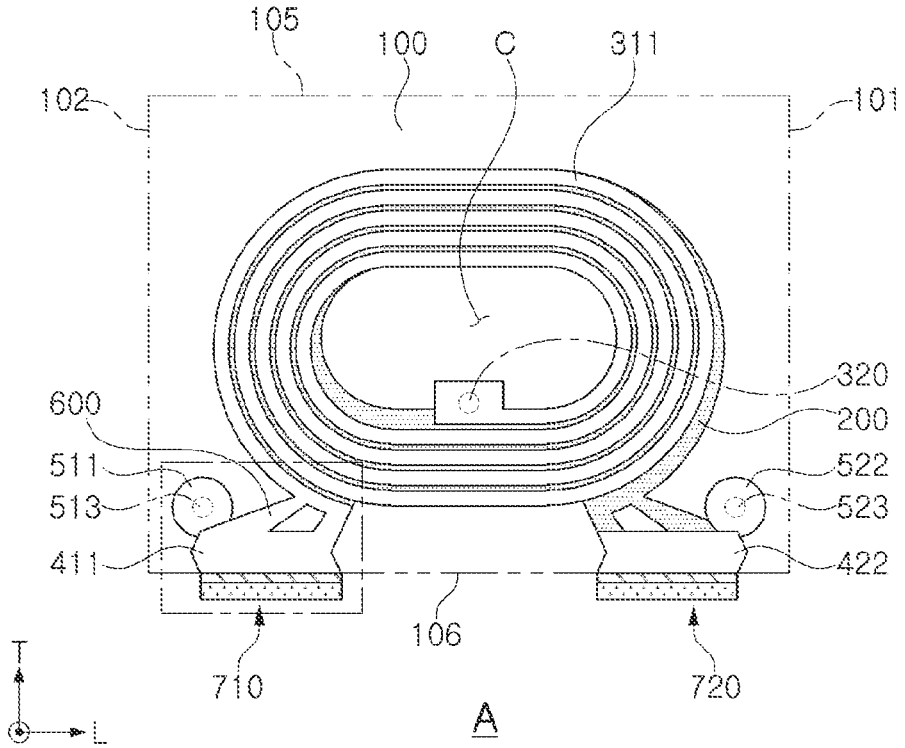
FIG. 3 is a schematic view taken in direction A of FIG. 1.
Figure 4:
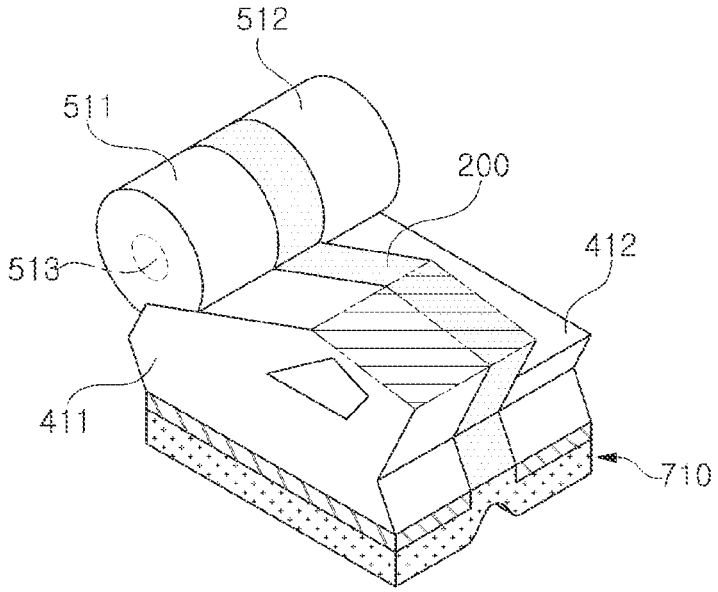
FIG. 4 illustrate that a first lead-out portion and a first anchor portion, disposed in a dashed line region of FIG. 3, are separated from each other.

FIG. 1 is a schematic perspective view of a coil component according to a first embodiment of the present disclosure. FIG. 2 is a schematic perspective view of the coil component according to the first embodiment of the present disclosure when viewed from below. FIG. 3 is a schematic view taken in direction A of FIG. 1. FIG. 4 illustrates that a first lead-out portion and a first anchor portion, disposed in a dashed line region of FIG. 3, are separated from each other. FIG. 3 is a schematic view taken in direction A of FIG. 1, and illustrates an internal structure of the coil component according to the first embodiment of the present disclosure.

Referring to FIGS. 1 to 4, a coil component 1000 according to an exemplary embodiment may include a body 100, a support substrate 200, a coil portion 300, a lead-out portion 410 and 420, anchor portions 510 and 520, a connection portion 600, and external electrodes 710 and 720.

The body 100 may form an exterior of the coil portion 1000 according to this embodiment, and may embed the coil portion 300 therein.

The body 100 may be formed to have a hexahedral shape overall.

The body 100 has a first surface 101 and a second surface 102 opposing each other in a length direction L, a third surface 103 and a fourth surface 104 opposing each other in a width direction W, and a fifth surface 105 and a sixth surface 106 opposing each other in a thickness direction T, based on FIGS. 1, 2, and 3. Each of the first to fourth surfaces 101, 102, 103, and 104 of the body 100 may correspond to a wall surface of the body 100 connecting the fifth surface 105 and the sixth surface 106 of the body 100. Hereinafter, both end surfaces of the body 100 may refer to the first surface 101 and the second surface 102, respectively, both side surfaces of the body 100 may refer to the third surface 103 and the fourth surface 104 of the body 100, respectively, and one surface and the other surface of the body 100 may refer to the sixth surface 106 and the fifth surface 105 of the body 100, respectively.

As an example, the body 100 may be formed in such a manner that the coil component 1000, in which the external electrodes 710 and 720 to be described later are formed, has a length of 1.0 mm, a width of 0.5 mm, and a thickness of 0.8 mm, but the present disclosure is not limited thereto. Since the above values are only values in design which do not reflect process errors, or the like, they should be regarded as belonging to the scope of the present disclosure to the extent that they can be recognized as process errors.

The term "length of the coil component 1000" may refer to, based on an optical microscope or scanning electron microscope (SEM) image fora cross section in a length-thickness (L-T) direction in a central portion of the coil component 1000 in a width (W) direction, a maximum value, among lengths of a plurality of segments connecting outermost boundary lines of the coil component illustrated in the cross-sectional image and parallel to the length (L) direction. Alternatively, the term "length of the coil component 1000" may refer to, based on an optical microscope or scanning electron microscope (SEM) image for a cross section in a length-thickness (L-T) direction in a central portion of the coil component 1000 in a width (W) direction, a minimum value, among lengths of a plurality of segments connecting outermost boundary lines of the coil component illustrated in the cross-sectional image and parallel to the length (L) direction. Alternatively, the term "length of the coil component 1000" may refer to, based on an optical microscope or scanning electron microscope (SEM) image for a cross section in a length-thickness (L-T) direction in a central portion of the coil component 1000 in a width (W) direction, an arithmetic mean of at least three lengths, among lengths of a plurality of segments connecting outermost boundary lines of the coil component illustrated in the cross-sectional image and parallel to the length (L) direction.

The term "thickness of the coil component 1000" may refer to, based on an optical microscope or scanning electron microscope (SEM) image fora cross section in a length-thickness (L-T) direction in a central portion of the coil component 1000 in a width (W) direction, a maximum value, among lengths of a plurality of segments connecting outermost boundary lines of the coil component illustrated in the cross-sectional image and parallel to the thickness (T) direction. Alternatively, the term. "thickness of the coil component 1000" may refer to, based on an optical microscope or scanning electron microscope (SEM) image for a cross section in a length-thickness (L-T) direction in a central portion of the coil component 1000 in a width (W) direction, a minimum value, among lengths of a plurality of segments connecting outermost boundary lines of the coil component illustrated in the cross-sectional image and parallel to the thickness (T) direction. Alternatively, the term "thickness of the coil component 1000" may refer to, based on an optical microscope or scanning electron microscope (SEM) image for a cross section in a length-thickness (L-T) direction in a central portion of the coil component 1000 in a width (W) direction, an arithmetic mean of at least three lengths, among lengths of a plurality of segments connecting outermost boundary lines of the coil component illustrated in the cross-sectional image and parallel to the thickness (T) direction.

The term "width of the coil component 1000" may refer to, based on an optical microscope or scanning electron microscope (SEM) image for a cross section in a width-thickness (W-T) direction in a central portion of the coil component 1000 in a length (L) direction, a maximum value, among lengths of a plurality of segments connecting outermost boundary lines of the coil component illustrated in the cross-sectional image and parallel to the width (W) direction. Alternatively, the term "width of the coil component 1000" may refer to, based on an optical microscope or scanning electron microscope (SEM) image for a cross section in a width-thickness (W-T) direction in a central portion of the coil component 1000 in a length (L) direction, a minimum value, among lengths of a plurality of segments connecting outermost boundary lines of the coil component illustrated in the cross-sectional image and parallel to the width (W) direction. Alternatively, the term "width of the coil component 1000" may refer to, based on an optical microscope or scanning electron microscope (SEM) image for a cross section in a width-thickness (W-T) direction in a central portion of the coil component 1000 in a length (L) direction, an arithmetic mean of at least three lengths, among lengths of a plurality of segments connecting outermost boundary lines of the coil component illustrated in the cross-sectional image and parallel to the width (W) direction.

Each of the length, the width, and the thickness of the coil component 1000 may be measured by a micrometer measurement method. In the micrometer measurement method, measurement may be performed by setting a zero point using a micrometer with gage repeatability and reproducibility (R&R), inserting the coil component 1000 inserted between tips of the micrometer, and turning a measurement lever of the micrometer. When the length of the coil component 1000 is measured by a micrometer measurement method, the length of the coil component 1000 may refer to a value measured once or an arithmetic mean of values measured multiple times. This may be equivalently applied to the width and the thickness of the coil component 1000.

The body 100 may include a magnetic material and a resin. Specifically, the body 100 may be formed by laminating at least one magnetic composite sheet in which a magnetic material is dispersed in a resin. However, the body 100 may have a structure other than the structure in which a magnetic material is dispersed in a resin. For example, the body 100 may be formed of a magnetic material, such as ferrite, or a nonmagnetic material.

The magnetic material may be ferrite or magnetic metal powder particles.

Examples of the ferrite powder particles may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder particle may be amorphous or crystalline. For example, the magnetic metal powder particle may be a Fe—Si—B—Cr-based amorphous alloy powder, but is not limited thereto.

Each of the magnetic metal powder particles may have an average diameter of about 0.1 μm to 30 μm, but is not limited thereto.

The body 100 may include two or more types of magnetic metal powder particle dispersed in a resin. The term "different types of magnetic powder particle" means that the magnetic powder particles, dispersed in the resin, are distinguished from each other by at least one of average diameter, composition, crystallinity, and shape.

The resin may include epoxy, polyimide, liquid crystal polymer, or the like, in a single form or combined forms, but is not limited thereto.

The body 100 may include a core 110 penetrating through a central portion of each of the support substrate 200 and the coil portion 300. The core 110 may be formed by filling the central portion of the coil portion 300 with a magnetic composite sheet, but the present disclosure is not limited thereto.

The support substrate 200 may support the coil portion 300 and the lead-out portions 410 and 420, and the anchor portions 510 and 520 to be described later.

The support substrate 200 may be disposed in the body 100 such that one surface of the support substrate 200 is perpendicular to the one surface 106 of the body 100. The sixth surface 106 of the body 100 may be used as a mounting surface when the coil component 1000 according to this embodiment is mounted on a mounting board such as a printed circuit board. In this embodiment, since one surface of the support substrate 200 is disposed to be perpendicular to the sixth surface 106 of the body 100, the coil portion 300 to be described later and disposed on the support substrate 200 may function as a vertical-type coil. Since a magnetic field, induced in the core C of the body 100 by the coil portion 300 functioning as a vertical-type coil, is parallel to the sixth surface 106 of the body 100, the coil component 1000 according to this embodiment may reduce noise induced to the mounting board, or the like.

The support substrate 200 may include an insulating material, for example, a thermosetting insulating resin such as an epoxy resin, a thermoplastic insulating resin such as polyimide, or a photosensitive insulating resin, or the support substrate 200 may include an insulating material in which a reinforcing material such as a glass fiber or an inorganic filler is impregnated with an insulating resin. For example, the support substrate 200 may include an insulating material such as prepreg, Ajinomoto Build-up Film (ABF), FR-4, a bismaleimide triazine (BT) film, a photoimageable dielectric (PID) film, a copper clad laminate (CCL), and the like, but are not limited thereto.

The inorganic filler may be at least one or more selected from the group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support substrate 200 is formed of an insulating material including a reinforcing material, the support substrate 200 may provide more improved rigidity. When the support substrate 200 is formed of an insulating material including no glass fiber, the support substrate 200 is advantageous for thinning the entire coil portion 300 to reduce a width of a component. When the support substrate 200 is formed of an insulating material including a photosensitive insulating resin, the number of processes for forming the coil portion 300 may be decreased. Therefore, it may be advantageous in reducing production costs, and a fine via may be formed.

The coil portion 300 may be disposed on the support substrate 200. The coil portion 300 may be embedded in the body 100 to express characteristics of the coil component 1000. For example, when the coil component 1000 is used as a power inductor, the coil portion 300 may store an electric field as a magnetic field to maintain an output voltage, serving to stabilize power of an electronic device.

The coil portion 300 may be formed on at least one of both surfaces of the support substrate 200, opposing each other, and may form at least one turn. The coil portion 300 may be disposed on one surface and the other surface of the support substrate 200, opposing each other in the width direction W of the body 100. Specifically, in this embodiment, the coil portion 300 may include coil patterns 311 and 312 and a via 320.

Each of the first coil pattern 311 and the second coil pattern 312 may be in the form of a planar spiral in which at least one turn is formed around the core C of the body 100. For example, based on the direction of FIG. 1, the first coil pattern 311 may form at least one turn around the core C on a front surface of the support substrate 200. The second coil pattern 312 forms at least one turn around the core C on a rear surface of the support substrate 200. Each of the first and second coil patterns 311 and 312 may be formed in such a manner that an end portion of an outermost turn, connected to lead-out pattern 411 and 412 of the lead-output portions 410 and 420 to be described later, extends further to a side of the sixth surface 106 of the body 100 than a central portion of the body 100 in the thickness (T) direction. As a result, the first and second coil patterns 311 and 312 may increase the overall number of turns of the coil portion 300, as compared to the case in which an end portion of an outermost turn of a coil is formed to only a central portion of a body in a thickness direction.

The via 320 may penetrate through the support substrate 200 to connect innermost turns of the first and second coil patterns 311 and 312.

Thus, the coil portion 300 may function as a single coil connected overall.

The lead-out portions 410 and 420 may be connected to the outermost turn of the coil portion 300, and may be exposed to be spaced apart from each other on the one surface 106 of the body 100. Specifically, the lead-out portions 410 and 420 may include a first lead-out portion 410, connected to an end portion of an outermost turn of the first coil pattern 311, and a second lead-out portion 420 connected to an end portion of an outermost turn of the second coil pattern 312. The first lead-out portion 410 and the second lead-out portion 420 may be exposed to be spaced apart from each other on the sixth surface 106 of the body 100.

The lead-out portions 410 and 420 may be disposed to correspond to each other on one surface and the other surface of the support substrate 200, opposing each other on the support substrate 200, and may include lead-out patterns 411 and 421 and auxiliary lead-out patterns 412 and 422 exposed to the one surface of the body 106, respectively. Specifically, the first lead-out portion 410 may include a first lead-out pattern 411, disposed on one surface of the support substrate 200, and a first auxiliary lead-out pattern 412 disposed to correspond to the first lead-out pattern 411 on the other surface of the support substrate 200. The second lead-out portion 420 may include a second lead-out pattern 421, disposed on the other surface of the support substrate 200, and a second auxiliary lead-out pattern 422 disposed to correspond to the second lead-out pattern 421 on the one surface of the support substrate 200. The first lead-out pattern 411 may be connected to an end portion of an outermost turn of the first coil pattern 311 by the connection portion 600 to be described later, and the second lead-out pattern 421 may be connected to an end portion of an outermost turn of the second coil pattern 312 by the connection portion 600 to be described later. The first auxiliary lead-out pattern 412 may be spaced apart from the second coil pattern 312, and the second auxiliary lead-out pattern 422 may be spaced apart from the first coil pattern 311. The auxiliary lead-out patterns 412 and 422 are not directly connected to the coil portion 300 but may be connected to each other through the lead-out patterns 411 and 421, connected to the coil portion 300 through the connection portion 300, and the anchor portions 510 and 520 to be described later. The auxiliary lead-out patterns 412 and 422 may be disposed in locations corresponding to the lead-out patterns 411 and 421 on both surfaces of the support substrate 200 to be exposed to the sixth surface 106 of the body 100 with areas corresponding to the lead-out patterns 411 and 421, respectively. Therefore, poor exteriors of external electrodes 710 and 720 to be described later may be prevented when the external electrodes 710 and 720 are formed on the surface of the body 100.

The anchor portions 510 and 520 may be connected to the lead-out portions 410 and 420, and may include via pads 511, 512, 521, and 522 disposed between the lead-out portions 410 and 420 and the coil portion 300 in the body 100.

Specifically, the anchor portions 510 and 520 may include a first anchor portion 510 connected to the first lead-out portion 410, and a second anchor portion 520 connected to the second lead-out portion 420. The first anchor portion 510 may include a first via pad 511 connected to the first lead-out pattern 411, a first via pad 512 connected to the first auxiliary lead-out pattern 412, and a first connection via 513 penetrating through the support substrate 200 to connect the first via pads 511 and 512 to each other. The second anchor portion 520 may include a second via pad 521 connected to the second lead-out pattern 421, a second via pad 522 connected to the second auxiliary lead-out pattern 422, and a second connection via 523 penetrating through the support substrate 200 to connect the second via pads 521 and 522 to each other.

The via pads 511, 512, 521, and 522 may be in contact with, and connected to, the lead-out portions 410 and 420. For example, the first lead-out pattern 411 and the first via pad 511 may be in contact with, and connected to, each other, the first auxiliary lead-out pattern 412 and the first via pad 512 may be in contact with, and connected to, each other, and the second lead-out pattern 421 and the second via pad 521 may be in contact with, and connected to, each other, and the second auxiliary lead-out pattern 422 and the second via pad 522 may be in contact with, and connected to, each other.

The anchor portions 510 and 520 may extend inwardly of the body 100 from the lead-out portions 410 and 420, as being in the form spaced apart from the outermost turn of the coil portion 300. The anchor portions 510 and 520 may prevent each of the coil portion 300 and the lead-out portions 410 and 420 from being delaminated from the body 100 by external force. As an example, the first anchor portion 510 may extend from the first lead-out portion 410 in the form of having an angle range of more than 0 degree to 90 degrees or less. The phrase "the first anchor portion 510 has an angle range of more than 0 degree to 90 degrees or less from the first lead-out portion 410" may mean that, as an example, based on the cross section of the body 100 in the length-thickness (L-T) direction, a segment connecting a center of the first connection via 513 of the first anchor 510 and a center of an exposed surface, on which the first lead-out pattern 411 of the first lead-out pattern 410 is exposed to the sixth surface 106 of the body 100, has an angle range of more than 0 degree to 90 degrees or less to each other with respect to the sixth surface 106 of the body 100, but the present disclosure is not limited thereto.

The connection portion 600 may be in contact with, and connected to, the outermost turn of the coil portion 300 and the lead-out portions 410 and 420. For example, the connection portion 600 may be disposed between the outermost turn of the coil portion 300 and the lead-out portions 410 and 420, and may be in contact with, and connected to, the outermost turn of the coil portion 300 and the lead-out portions 410 and 420.

The connection portion 600 may include a plurality of connection portions 600 spaced apart from each other. As an example, the connection portion 600 may include a plurality of connection portions 600 spaced apart from each other between an end portion of an outermost turn of the first coil pattern 311 and the first lead-out pattern 411. Each of the plurality of connection portions 600, spaced apart from each other, may connect the end portion of the outermost turn of the first coil pattern 311 to the first lead-out pattern 411. In addition, the connection portion 600 may include a plurality of connection portions 600 spaced apart from each other between an end portion of the outermost turn of the second coil pattern 312 and the second lead-out pattern 421. Each of the plurality of connection portions 600, spaced apart from each other, may connect the end portion of the outermost turn of the second coil pattern 312 to the second lead pattern 421. At least a portion of the body 100 may be disposed between the plurality of connection portions 600 spaced apart from each other. As a result, bonding strength between each of the lead-out portions 410 and 420 and the body 100 may be improved.

Although intensive descriptions of the first lead-out portion 410 and the first anchor portion 510 have been given, the descriptions may be equivalently applied to the second lead-out portion 420 and the second anchor portion 520.

Each of the coil portion 300, the lead-out portions 410 and 420, the anchor portions 510 and 520, and the connection portion 600 may include a conductive material such as copper (Cu), aluminum (Al), silver (Ag), tin (Sn), gold (Au), nickel (Ni), lead (Pb), titanium (Ti), chromium (Cr), molybdenum (Mo), or alloys thereof, but the conductive material is not limited thereto. In one example, the coil portion 300, the lead-out portions 410 and 420, the anchor portions 510 and 520, and the connection portion 600 may include a same conductive material. In this case, each of the anchor portions 510 and 520 may include a conductive pattern.

Each of the coil portion 300, the lead-out portions 410 and 420, the anchor portions 510 and 520, and the connection portion 600 may include at least one conductive layer. For example, when the first coil pattern 311, the via 320, the connection portion 600, the first lead-out pattern 411, the first via pad 511, the first connection via 513, the second auxiliary lead-out pattern 422, the second via pad 521, and the first connection via 523 are formed on the front surface of the support substrate 200 (based on the direction of FIG. 1) by plating, each of the first coil pattern 311, the via 320, the first lead-out pattern 411, the first via pad 511, the first connection via 513, the second auxiliary lead-out pattern 422, the second via pad 521, and first connection via 523 may include a seed layer and an electroplating layer. The seed layer may be formed by vapor deposition such as electroless plating or sputtering. Each of the seed layer and the electroplating layer may have a single-layer structure or a multilayer structure. The electroplating layer having a multilayer structure may have a conformal film structure in which one electroplating layer is covered with another electroplating layer, or another electroplating layer is laminated on only one surface of one electroplating layer. The seed layer of the first coil pattern 311 and the seed layer of the via 320 may be integrally formed, such that a boundary may not be formed therebetween, but the present disclosure is not limited thereto. The electroplating layer of the first coil pattern 311 and the electroplating layer of the via 320 may be integrally formed such that a boundary may not be formed therebetween, but the present disclosure is not limited thereto.

In the case of this embodiment, since the coil portion 300 is disposed to be perpendicular to the sixth surface 106 of the body 100, a mounting surface, a mounting area may be reduced while maintaining the volume of the body 100. Therefore, a larger number of electronic components may be mounted on a mounting board having the same area. In addition, in the case of this embodiment, since the coil portion 300 is disposed to be perpendicular to the sixth surface 106 of the body 100, a mounting surface, a direction of magnetic flux induced in the core C by the coil portion 300 is parallel to the sixth side 106 of the body 100. Therefore, noise induced to the mounting surface of the mounting substrate may be relatively reduced.

The external electrodes 710 and 720 may be disposed to be spaced apart from each other on the sixth surface 106 of the body 100 to be connected to the lead-out portions 410 and 420, respectively. Specifically, the first external electrode 710 may be disposed on the sixth surface 106 of the body 100 to be in contact with, and connected to, each of the first lead-out pattern 411 and the first auxiliary lead-out pattern 412. The second external electrode 720 may be disposed on the sixth surface 106 of the body 100 to be in contact with, and connected to, each of the second lead-out pattern 421 and the second auxiliary lead-out pattern 422. In this embodiment, since the external electrodes 710 and 720 and the auxiliary lead patterns 412 and 422 are respectively in contact with, and connected to, each other, connection reliability between the external electrodes 710 and 720 and the coil portion 300 may be improved. As an example, the support substrate 200 may be disposed between the first lead-out pattern 411 and the first auxiliary lead-out pattern 412 to be exposed to the sixth surface 106 of the body 100. In this case, a recess may be formed in a region of the first external electrode 710, corresponding to the support substrate 200 exposed to the sixth surface 106 of the body 100 due to plating deviation, but the present disclosure is limited thereto.

The external electrodes 710 and 720 may electrically connect the coil component 1000 to a printed circuit board, or the like, when the coil component 1000 is mounted on the printed circuit board, or the like. As an example, the coil component 1000 may be mounted in such a manner that the sixth surface 106 of the body 100 may face an upper surface of the printed circuit board, and the external electrodes 710 and 720, disposed to be spaced apart from each other on the sixth surface 106 of the body 100, and a connection portion of the printed circuit board may be connected to each other.

The external electrodes 710 and 720 may be formed of a conductive material such as copper (Cu), aluminum (Al), silver (Ag), tin (Sn), gold (Au), nickel (Ni), lead (Pb), chromium (Cr), titanium (Ti), or alloys thereof, but the conductive material is not limited thereto.

Each of the external electrodes 710 and 720 may be formed to have a multilayer structure. As an example, each of the external electrodes 710 and 720 may include a first metal layer, disposed to be in contact with the lead-out portions 410 and 420, and a second metal layer disposed on the first metal layer. The first metal layer may be formed by vapor deposition such as sputtering, electroless plating, or electroplating, or may be formed by coating and curing a conductive resin including conductive powder particles such as copper (Cu). The second metal layer may be formed on the first metal layer by electroplating. The second metal layer may be formed to have a multilayer structure and, as a non-limiting example, may include a first plating layer and a second plating layer formed on the first plating layer. As an example, the first metal layer may include copper (Cu), the first plating layer may include nickel (Ni), and the second plating layer may include tin (Sn).

The coil component 1000 according to this embodiment may further include an insulating layer formed along surfaces of the support substrate 200, the coil portion 300, the lead-out portions 410 and 420), the anchor portions 510 and 520, and the connection portion 600. The insulating layer may be provided to insulate the coil portion 300 from the body 100 and may include a known insulating material such as parylene, but the present disclosure is not limited thereto. The insulating layer may be formed by a method such as vapor deposition. However, the present disclosure is not limited thereto, and the insulating layer may be formed by laminating an insulating film on both surfaces of the support substrate 200.

The coil component 1000 according to this embodiment may further include an insulating layer disposed on each of the first to fifth surfaces 101, 102, 103, 104, and 105 of the body 100 and in a region, in which the external electrodes 710 and 720 are not formed, on the sixth surface 106 of the body 100. The insulating layer may include at least one of a thermoplastic resin such as a polystyrene-based resin, a vinyl acetate-based resin, a polyester-based resin, a polyethylene-based resin, a polypropylene-based resin, a polyamide-based resin, a rubber-based resin, or an acrylic-based resin, a thermosetting resin such as a phenol-based resin, an epoxy-based resin, a urethane-based resin, a melamine-based resin, or an alkyd-based resin, and a photosensitive insulating resin.

Second Embodiment

Figure 5:
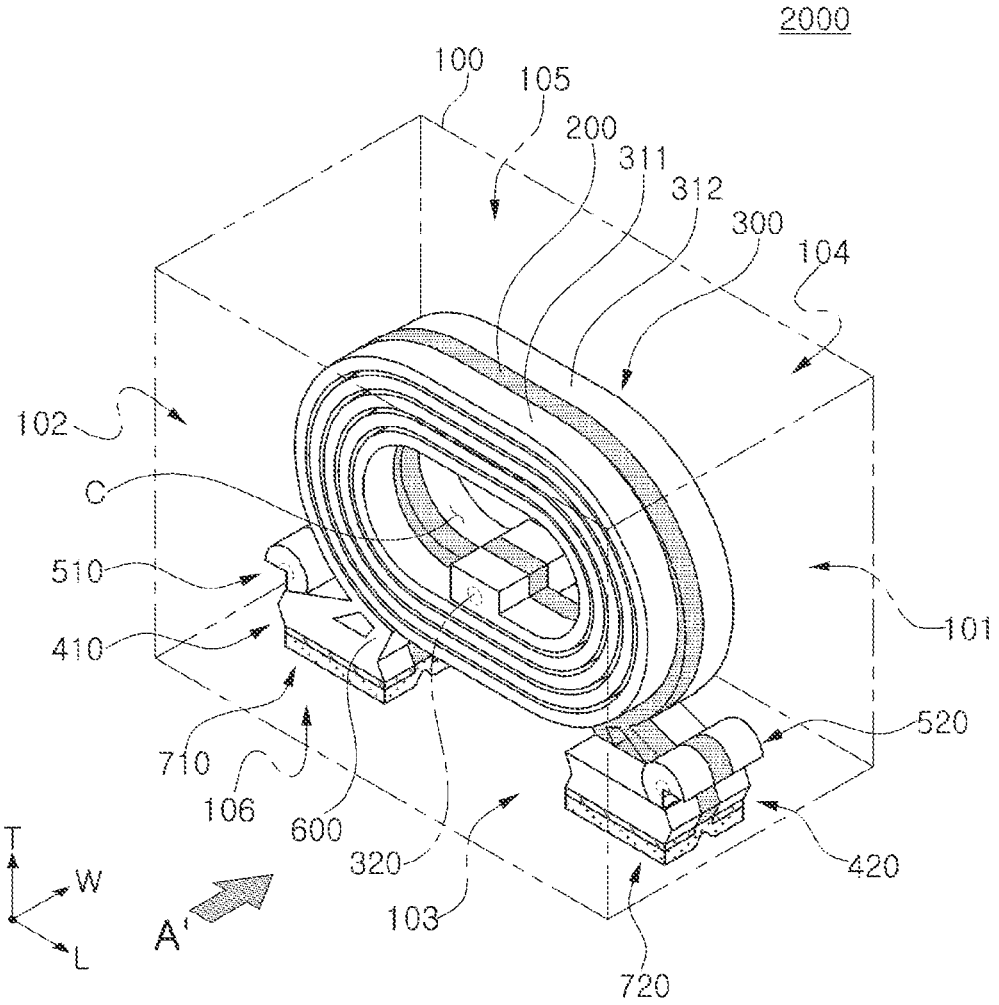
FIG. 5 is a schematic perspective view of a coil component according to a second embodiment of the present disclosure.
Figure 6:
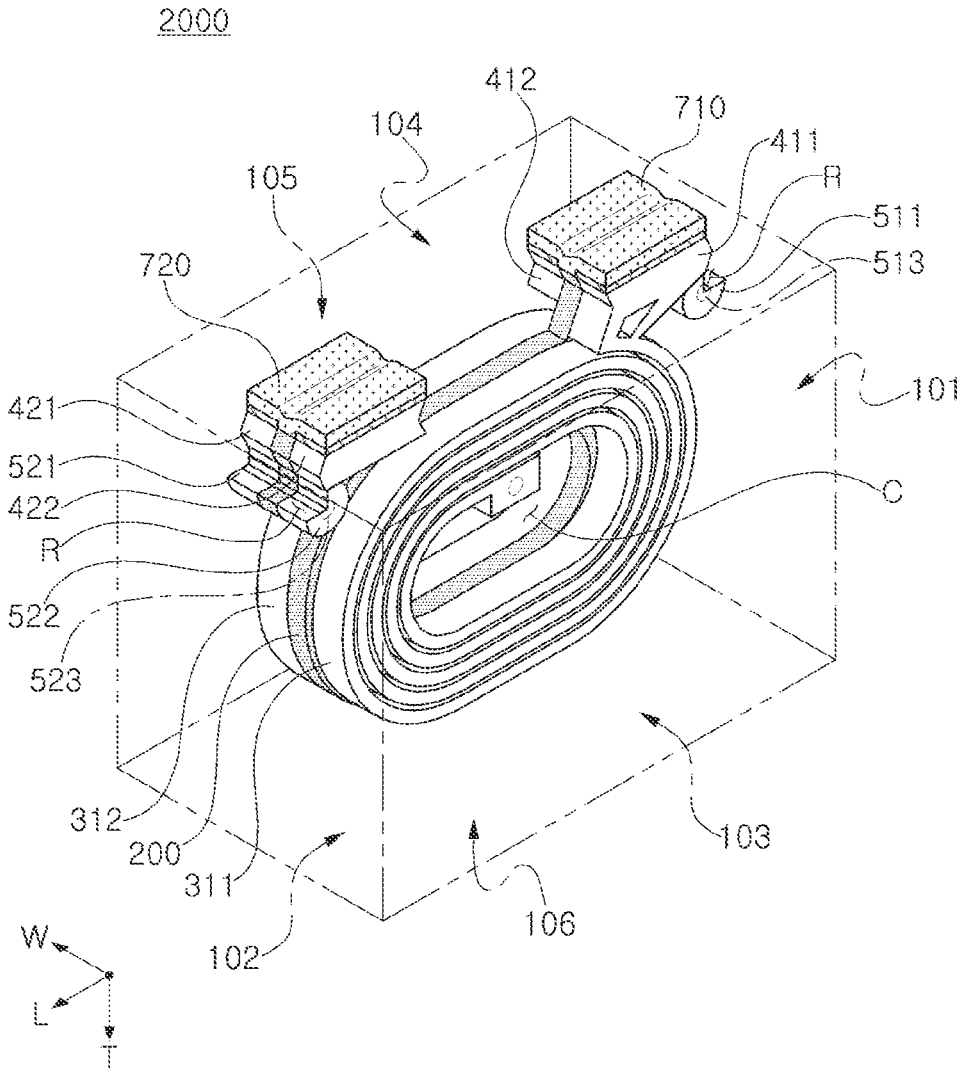
FIG. 6 is a schematic perspective view of the coil component according to the second embodiment of the present disclosure when viewed from below.
Figure 7:
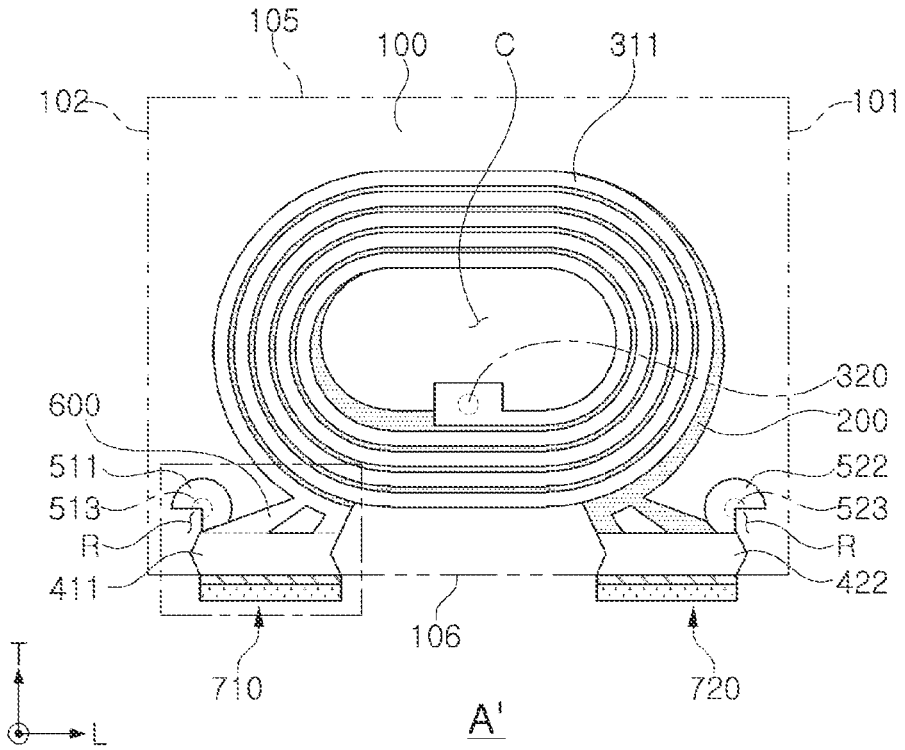
FIG. 7 is a schematic view taken in direction A' of FIG. 5.
Figure 8:
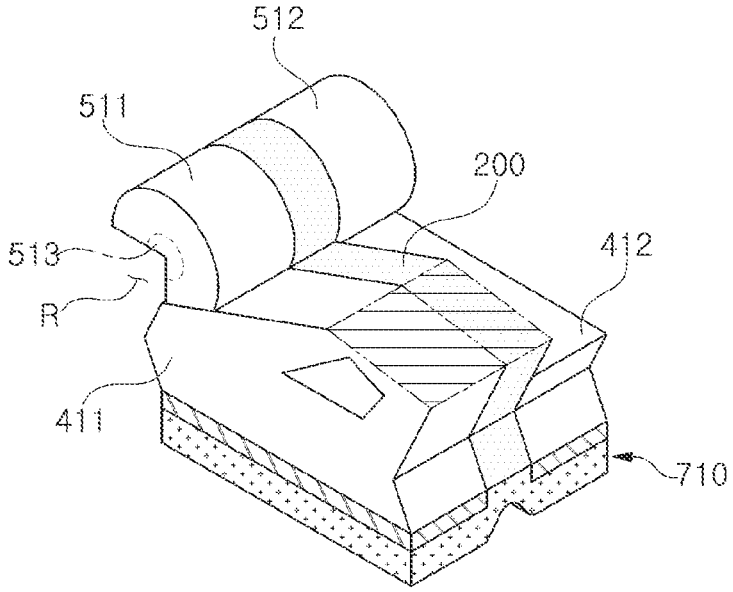
FIG. 8 illustrate that a first lead-out portion and a first anchor portion, disposed in a dashed line region of FIG. 7, are separated from each other.

FIG. 5 is a schematic perspective view of a coil component according to a second embodiment of the present disclosure. FIG. 6 is a schematic perspective view of the coil component according to the second embodiment of the present disclosure when viewed from below. FIG. 7 is a schematic view taken in direction A' of FIG. 5. FIG. 8 illustrate that a first lead-out portion and a first anchor portion, disposed in a dashed line region of FIG. 7, are separated from each other. FIG. 7 is a schematic view taken in direction A' of FIG. 5, and illustrates an internal structure of the coil component according to the second embodiment of the present disclosure.

Referring to FIGS. 1 to 4 and FIGS. 5 to 8, a coil component 2000 according to the second embodiment includes anchor portions 510 and 520, different from those of the coil component 1000 according to the first embodiment. Therefore, only the anchor portions 510 and 520 of the second embodiment will be described. With respect to the other elements, the description of the first embodiment may be applied as it is.

Referring to FIGS. 5 to 8, a groove R is formed in at least one of via pads 511, 512, 521, and 522 of the anchor portions 510 and 520 applied to the second embodiment. Specifically, at least one of the via pads 511, 512, 521, and 522 may have a shape, in which a groove R is formed, on a cross section in a length-width (L-W) direction perpendicular to the sixth surface 106 of the body 100. While a typical via pad is formed to have circular shape overall, at least one of the via pads 511, 512, 521, and 522 applied to the second embodiment may be formed to have a circular cross-sectional shape with, for example, ¼ removed overall. At least a portion of the body 100 is disposed in a portion, removed by forming the groove R, among the via pads 511, 512, 521, and 522. As a result, bonding strength between the anchor portions 510 and 520 and the body 100 may be further improved. The groove R may be formed, for example, in a third quadrant region of the first via pad 511 based on the coordinates of FIG. 7. As an example, the groove R formed in the first via pad 511 may have a shape open toward an edge formed by the sixth surface 106 of the body 100 and the second surface 102 of the body 100.

The groove R may be formed to penetrate through the anchor portions 510 and 520. As an example, the groove R may have a shape extending in a width (W) direction of the body 100 to penetrate through each of the first via pads 511 and 512 and a first connection via 513. As a result, unlike the first embodiment, the first connection via 513 of the second embodiment may have a shape exposed to the body 100.

While the above description has focused on the first lead-out portion 410 and the first anchor portion 510, such a description may be equivalently applied to the second lead-out 420 and the second anchor portion 520.

Third Embodiment

Figure 9:
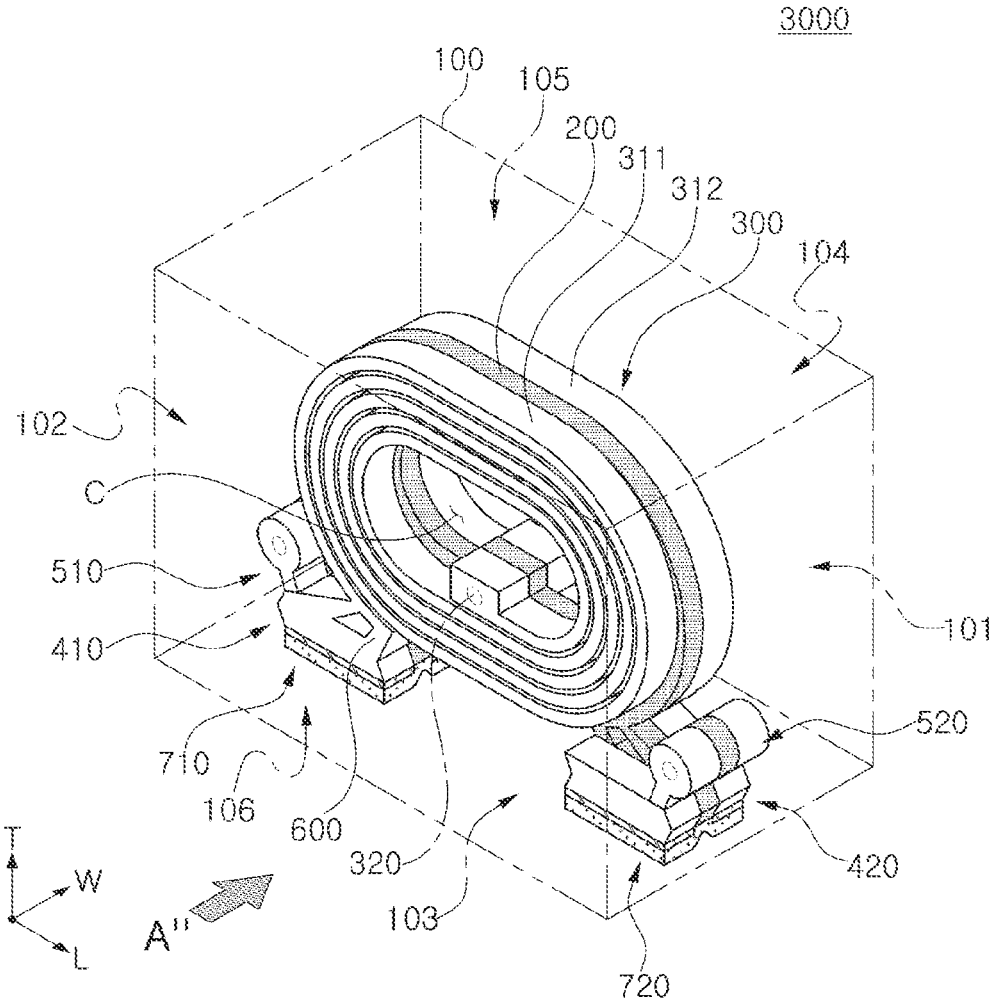
FIG. 9 is a schematic perspective view of a coil component according to a third embodiment of the present disclosure.
Figure 10:
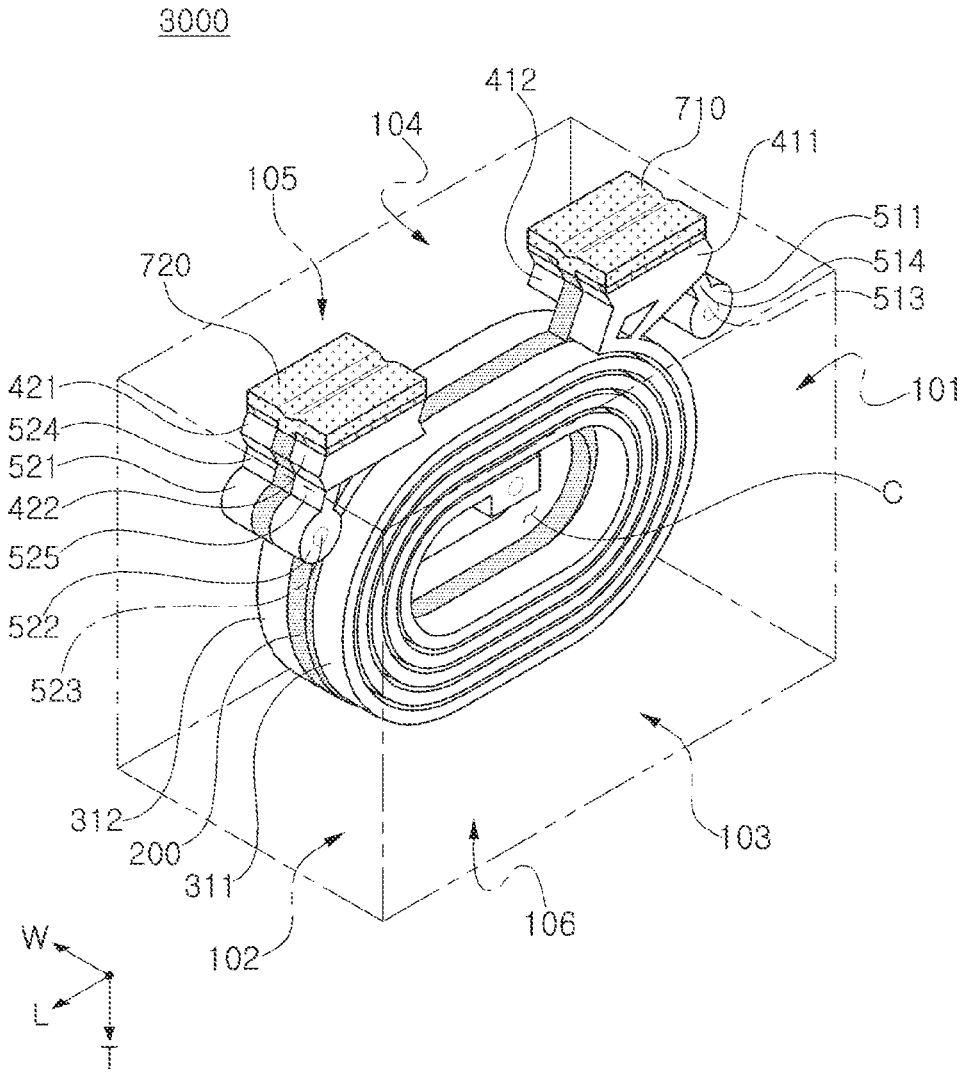
FIG. 10 is a schematic perspective view of the coil component according to the third embodiment of the present disclosure when viewed from below.
Figure 11:
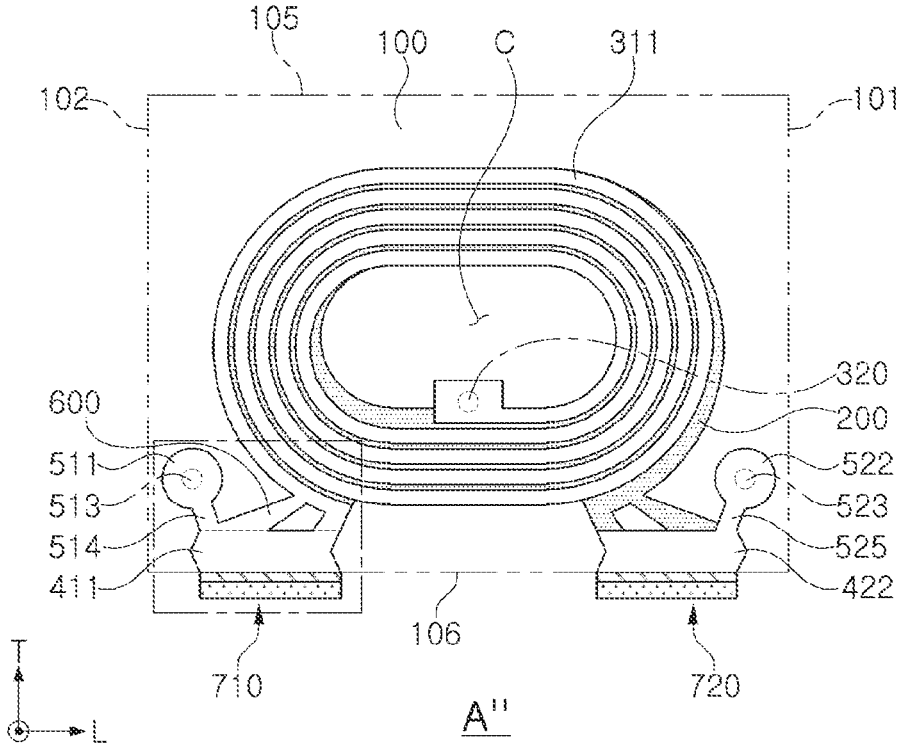
FIG. 11 is a schematic view taken in direction A" of FIG. 9.
Figure 12:
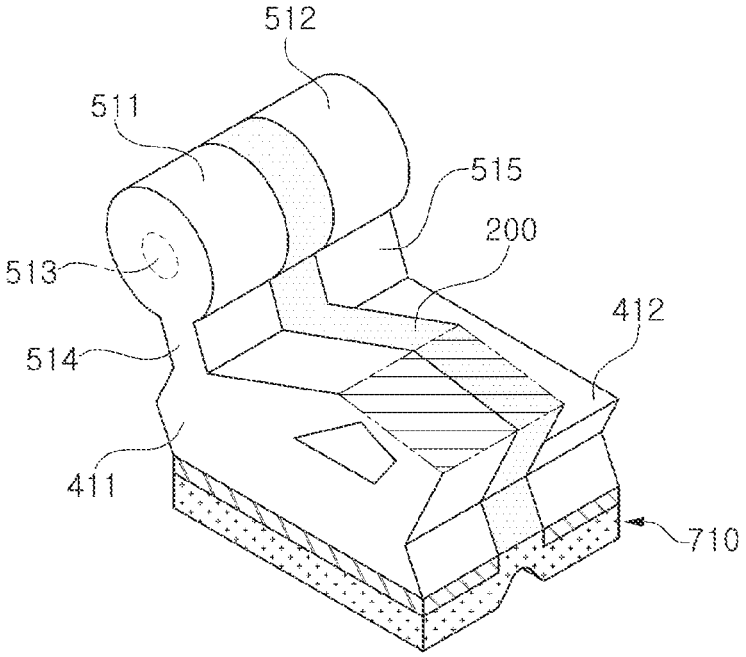
FIG. 12 illustrate that a first lead-out portion and a first anchor portion, disposed in a dashed line region of FIG. 11, are separated from each other.

FIG. 9 is a schematic perspective view of a coil component according to a third embodiment of the present disclosure. FIG. 10 is a schematic perspective view of the coil component according to the third embodiment of the present disclosure when viewed from below. FIG. 11 is a schematic view taken in direction A" of FIG. 9. FIG. 12 illustrate that a first lead-out portion and a first anchor portion, disposed in a dashed line region of FIG. 11, are separated from each other. FIG. 11 is a schematic view taken in direction A" of FIG. 1, and illustrates an internal structure of the coil component according to the third embodiment of the present disclosure.

Referring to FIGS. 1 to 4 and FIGS. 9 to 12, a coil component 3000 according to the third embodiment includes anchor portions 510 and 520, different from those of the coil component 1000 according to the first embodiment. Therefore, only the anchor portions 510 and 520 of the third embodiment will be described. With respect to the other elements, the description of the first embodiment may be applied as it is.

Referring to FIGS. 9 to 12, the anchor portions 510 and 520 applied to the third embodiment may further include connection patterns 514 and 524, connecting lead-out patterns 411 and 421 and via pads 511 and 521 spaced apart from each other, and auxiliary connection patterns 515 and 525 connecting auxiliary lead-out patterns 412 and 422 and the via pads 512 and 522 spaced apart from each other. Unlike the first embodiment, lead-out patterns 411 and 421, auxiliary lead-out patterns 412 and 422, and via pads 511, 512, 521 and 522 of the second embodiment are disposed to be spaced apart from each other, but are connected to each other by the connection patterns 514 and 524 and auxiliary connection patterns 515 and 525.

Specifically, the first lead-out pattern 411 and the first via pad 511 are spaced apart from each other, and the first connection pattern 514 is disposed between the first lead-out pattern 411 and the first via pad 511 to be in contact with, and connected to, each of the first lead-out pattern 411 and the first via pad 511. The first auxiliary lead-out pattern 412 and the first via pad 512 are spaced apart from each other, and the first auxiliary connection pattern 515 is disposed between the first auxiliary lead-out pattern 412 and the first via pad 512 to be in contact with, and connected to, each of the first auxiliary lead-out pattern 412 and the first via pad 512. The second lead-out pattern 421 and the second via pad 521 are spaced apart from each other, and the second connection pattern 524 is disposed between the second lead-out pattern 412 and the second via pad 521 to be in contact with, and connected to, each of the second lead-out pattern 412 and the second via pad 521. The second auxiliary lead-out pattern 422 and the second via pad 522 are spaced apart from each other, and the second auxiliary connection pattern 525 is disposed between the second auxiliary lead-out pattern 422 and the second via pad 522 to be in contact with, and connected to, each of the second auxiliary lead-out pattern 422 and the second via pad 522.

In the case of the third embodiment, since the lead-out portions 410 and 420 and the via pads 511, 512, 521, and 522 are separated from each other but are connected by connection patterns 514 and 524 and auxiliary connection patterns 515 and 525, a contact area between the anchor portions 510 and 520 and the body 100 may be increased and bonding strength therebetween may be improved.

As described above, according to an exemplary embodiment, bonding strength between a body and a coil portion may be improved.

According to an exemplary embodiment, bonding strength between a body and a lead-out portion may be improved.

According to an exemplary embodiment, the number of turns of a coil portion may be increased.

While exemplary embodiments have been shown and described above, it will be apparent to those skilled in the art that modifications and variations could be made without departing from the scope of the present disclosure as defined by the appended claims.

What is claimed is:

1. A coil component comprising:

a body having one surface and the other surface opposing each other;

a support substrate disposed inside the body;

a coil portion disposed on at least one surface of the support substrate;

a lead-out portion connected to an outermost turn of the coil portion and extending from the one surface of the body; and an anchor portion connected to the lead-out portion, and including a via pad disposed between the lead-out portion and the coil portion inside the body and a connection via penetrating through the support substrate to be connected to the via pad, wherein the via pad includes a first via pad and a second via pad, respectively disposed to correspond to the one surface and the other surface of the support substrate, and the connection via connects the first via pad and the second via pad to each other.

2. The coil component of claim 1, wherein the lead-out portion includes a lead-out pattern and an auxiliary lead-out pattern extending from the one surface of the body.

3. The coil component of claim 2, wherein the first via pad and the second via pad are in contact with, and connected to, the lead-out pattern and the auxiliary lead-out pattern, respectively.

4. The coil component of claim 3, wherein a groove is disposed in at least one of the first via pad and the second via pad on a cross section perpendicular to one surface of the body.

5. The coil component of claim 4, wherein the groove extends through the first via pad, the connection via, and the second via pad.

6. The coil component of claim 4, wherein the grove is open toward an edge between the one surface of the body and one side surface of the body, connected to the one surface of the body, on the cross section perpendicular to the one surface of the body.

7. The coil component of claim 2, wherein the anchor portion further includes a first connection pattern, connecting the lead-out pattern and the first via pad spaced apart from each other, and a second connection pattern connecting the auxiliary lead-out pattern and the second via pad spaced apart from each other.

8. The coil component of claim 1, further comprising:

a connection portion in contact with, and connected to, each of the outermost turn of the coil portion and the lead-out portion.

9. The coil component of claim 8, wherein the connection portion includes a plurality of connection portions spaced apart from each other.

10. The coil component of claim 9, wherein at least a portion of the body is disposed between the plurality of connection portions spaced apart from each other.

11. The coil component of claim 1, wherein the coil portion includes a first coil pattern and a second coil pattern, respectively disposed on the one surface and the other surface of the support substrate opposing each other, and a via penetrating through the support substrate to connect the one surface and the other surface of the support substrate to each other, the lead-out portion include a first lead-out portion, connected to an outermost turn of the first coil pattern, and a second lead-out portion connected to an outermost turn of the second coil pattern, and the anchor portion includes a first anchor portion connected to the first lead-out portion and a second anchor portion connected to the second lead-out portion.

12. The coil component of claim 11, further comprising:

a first external electrode and a second external electrode disposed to be spaced apart from each other on the one surface of the body and respectively connected to the first and second lead-out portions.

13. The coil component of claim 1, wherein the one surface of the support substrate is perpendicular to the one surface of the body.

14. The coil component of claim 1, wherein, an end portion of an outermost turn of the coil portion disposed closer to the one surface of the body than to the other surface of the body.

15. A coil component comprising:

a body having one surface and the other surface opposing each other;

a support substrate disposed inside the body;

a coil portion disposed on the support substrate;

a lead-out portion connected to an outermost turn of the coil portion and exposed to the one surface of the body; and an anchor portion extending from the lead out portion to a space between the coil portion, the lead-out portion, and a side surface of the body connecting the one surface and the other surface, wherein the anchor portion is spaced apart from each exterior surface of the body, the lead-out portion includes a lead-out pattern and an auxiliary lead-out pattern exposed to the one surface of the body, and the anchor portion includes a first via pad and a second via pad, respectively disposed to correspond to one surface and the other surface of the support substrate, and a connection via penetrating through the support substrate to be connected to the first via pad and the second via pad.

16. The coil component of claim 15, wherein the first via pad and the second via pad are in contact with, and connected to, the lead-out pattern and the auxiliary lead-out pattern, respectively.

17. The coil component of claim 15, wherein a groove is disposed in one of the first via pad and the second via pad on a cross section perpendicular to the one surface of the body.

18. The coil component of claim 15, wherein the anchor portion further includes a first connection pattern, connecting the lead-out pattern and the first via pad spaced apart from each other, and a second connection pattern connecting the auxiliary lead-out pattern and the second via pad spaced apart from each other.

19. A coil component comprising:

a body having one surface and the other surface opposing each other;

a support substrate disposed inside the body;

a coil portion disposed on the support substrate;

a lead-out portion connected to an outermost turn of the coil portion and exposed to the one surface of the body; and a conductive pattern, including a same material as the lead-out portion, extending from the lead-out portion to a space between the coil portion, the lead-out portion, and a side surface of the body connecting the one surface and the other surface, wherein the conductive pattern is spaced apart from the coil portion and each exterior surface of the body, the conductive pattern includes a first via pad and a second via pad, respectively disposed to correspond to one surface and the other surface of the support substrate, and a connection via penetrates through the support substrate to connect the first via pad and the second via pad to each other.

20. The coil component of claim 19, further comprising a connection portion extending from the lead-out portion to the coil portion.

* * * * *